US008910958B2

(12) United States Patent
Smith

(10) Patent No.: US 8,910,958 B2
(45) Date of Patent: Dec. 16, 2014

(54) SNOWBOARD TRAINING DEVICE

(76) Inventor: Christopher J. Smith, Jupiter, FL (US)

( * ) Notice: Subject to any disclaimer, the term of this patent is extended or adjusted under 35 U.S.C. 154(b) by 286 days.

(21) Appl. No.: 13/349,924

(22) Filed: Jan. 13, 2012

(65) Prior Publication Data

US 2013/0181417 A1 Jul. 18, 2013

(51) Int. Cl.
*A63C 17/01* (2006.01)

(52) U.S. Cl.
USPC ..... 280/87.042; 280/14.22

(58) Field of Classification Search
CPC ..... A63C 5/00; A63C 5/03; A63C 5/035; A63C 5/06; A63C 11/00; A63C 11/003; A63C 17/01; A63C 17/013; A63C 17/014; A63C 17/017; A63C 2203/00; A63C 2203/18; A63C 2203/22; A63C 2203/24; A63B 22/18; A63B 22/16; A63B 69/18; A63B 69/0093; A63B 2069/18; A63B 2244/19; G09B 9/00; G09B 9/02; G09B 9/04; G09B 9/05; G09B 6/052; G09B 9/066
USPC ..... 280/87.01, 87.021, 87.041, 87.042, 280/14.21, 14.22
See application file for complete search history.

(56) References Cited

U.S. PATENT DOCUMENTS

| | | | | | |
|---|---|---|---|---|---|
| 3,399,904 | A | * | 9/1968 | Schinke | 280/87.042 |
| 4,062,557 | A | * | 12/1977 | Roden | 280/87.042 |
| 4,353,566 | A | * | 10/1982 | Mohlenbrock | 280/87.042 |
| 4,886,298 | A | * | 12/1989 | Shols | 280/842 |
| 4,966,364 | A | * | 10/1990 | Eggenberger | 482/146 |
| 5,096,225 | A | * | 3/1992 | Osawa | 280/842 |
| 5,152,691 | A | * | 10/1992 | Moscarello | 434/247 |
| 5,312,258 | A | * | 5/1994 | Giorgio | 434/253 |
| 5,372,384 | A | * | 12/1994 | Smith | 280/842 |
| 5,492,352 | A | * | 2/1996 | St. Clair | 280/87.042 |
| 5,545,115 | A | * | 8/1996 | Corcoran | 482/146 |
| 5,553,874 | A | * | 9/1996 | Schouten et al. | 280/11.28 |
| 5,590,908 | A | * | 1/1997 | Carr | 280/809 |
| 5,855,385 | A | * | 1/1999 | Hambsch | 280/87.042 |
| 5,947,495 | A | * | 9/1999 | Null et al. | 280/87.042 |
| 5,975,546 | A | * | 11/1999 | Strand | 280/87.042 |
| 5,992,865 | A | * | 11/1999 | Vargas | 280/87.042 |
| 6,059,303 | A | * | 5/2000 | Bradfield | 280/87.042 |
| 6,158,753 | A | * | 12/2000 | Sturbaum | 280/87.042 |
| 6,237,960 | B1 | * | 5/2001 | Dornhofer | 280/842 |
| 6,267,394 | B1 | * | 7/2001 | Bouden | 280/87.042 |
| 6,270,096 | B1 | * | 8/2001 | Cook | 280/87.042 |
| 6,375,204 | B1 | * | 4/2002 | Tu | 280/87.042 |
| 6,431,568 | B1 | * | 8/2002 | McCleese | 280/87.042 |
| 6,602,172 | B1 | * | 8/2003 | Aigner | 482/147 |
| 6,698,776 | B2 | * | 3/2004 | Todd | 280/87.042 |
| 6,739,974 | B2 | * | 5/2004 | Kanno et al. | 463/36 |
| 6,848,527 | B2 | * | 2/2005 | Nelson | 180/181 |

(Continued)

FOREIGN PATENT DOCUMENTS

WO WO 2010143217 A1 * 12/2010 ..... A63C 5/035

*Primary Examiner* — Katy M Ebner
(74) *Attorney, Agent, or Firm* — Simpson & Simpson, PLLC

(57) ABSTRACT

A snowboard training device, including: a board; a first wheel assembly connected to an underside of the board and including first and second pairs of rotatable wheels with first and second axis of rotation, respectively; and a second wheel assembly connected to the underside of the board and including third and fourth pairs of rotatable wheels with third and fourth axis of rotation, respectively. The first and second axis are non-parallel. The third and fourth axis are non-parallel. The first and second portions of the first and second wheel assemblies, respectively, are displaceable with respect to the board.

20 Claims, 6 Drawing Sheets

(56) References Cited

U.S. PATENT DOCUMENTS

| | | | | |
|---|---|---|---|---|
| 7,213,823 | B1 * | 5/2007 | Vujtech | 280/87.021 |
| 7,374,179 | B2 * | 5/2008 | Cole | 280/11.27 |
| 7,441,787 | B1 * | 10/2008 | Jordan | 280/87.041 |
| 7,488,177 | B2 * | 2/2009 | Pearson | 434/247 |
| 7,581,735 | B2 * | 9/2009 | Birdsell et al. | 280/14.21 |
| 7,614,987 | B2 * | 11/2009 | Guadagno | 482/142 |
| 7,686,751 | B2 * | 3/2010 | Carlson et al. | 482/146 |
| 7,867,139 | B2 * | 1/2011 | Loane | 482/1 |
| 8,146,929 | B1 * | 4/2012 | Johnson | 280/87.042 |
| 8,398,099 | B2 * | 3/2013 | Edginton | 280/87.042 |
| 8,398,100 | B2 * | 3/2013 | Tedla | 280/87.042 |
| 8,540,284 | B2 * | 9/2013 | Falanga et al. | 280/842 |
| 2002/0070514 | A1 * | 6/2002 | Costa et al. | 280/11.226 |
| 2003/0107199 | A1 * | 6/2003 | DeSchinkel | 280/87.042 |
| 2003/0141688 | A1 * | 7/2003 | Lynn | 280/87.042 |
| 2006/0082089 | A1 * | 4/2006 | Rejtano | 280/87.042 |
| 2007/0184940 | A1 * | 8/2007 | Tomes | 482/92 |
| 2009/0203441 | A1 * | 8/2009 | Piccoli et al. | 463/36 |
| 2009/0227426 | A1 * | 9/2009 | Dubar | 482/34 |
| 2011/0124387 | A1 * | 5/2011 | Sauerbrei et al. | 463/7 |
| 2012/0126523 | A1 * | 5/2012 | Langer | 280/842 |
| 2012/0264579 | A1 * | 10/2012 | Klein et al. | 482/146 |
| 2012/0270193 | A1 * | 10/2012 | Piercey | 434/247 |

* cited by examiner

SNOWBOARD TRAINING DEVICE

TECHNICAL FIELD

The present disclosure relates to a snowboard training device, in particular a device enabling realistic simulation of snowboarding movements. The present disclosure also relates to a device for generating and transmitting a signal to simulate snowboard activity based on the motion of the device.

BACKGROUND

Snowboarding is a sport rapidly increasing in popularity. The known prior art does not teach a means for providing training in snowboarding in a location remote from a ski slope.

SUMMARY

According to aspects illustrated herein, there is provided a snowboard training device, including: a board; a first wheel assembly connected to an underside of the board and including first and second pairs of rotatable wheels with first and second axis of rotation, respectively; and a second wheel assembly connected to the underside of the board and including third and fourth pairs of rotatable wheels with third and fourth axis of rotation, respectively. The first and second axis are non-parallel. The third and fourth axis are non-parallel. The first and second portions of the first and second wheel assemblies, respectively, are displaceable with respect to the board.

According to aspects illustrated herein, there is provided a snowboard training device, including: a board; first and second wheel assemblies connected to an underside of the board and including respective pluralities of wheels; and a center assembly connected to the underside of the board. At least a portion of the center assembly is rotatable with respect to the board, and respective portions of the first and second wheel assemblies are pivotable with respect to the board.

According to aspects illustrated herein, there is provided a method of forming a snowboard training device, including: connecting a first wheel assembly, including first and second pairs of rotatable wheels with first and second axis of rotation, respectively, to an underside of a board such that a first portion of the first wheel assembly is displaceable with respect to the board; connecting a second wheel assembly, including third and fourth pairs of rotatable wheels with third and fourth axis of rotation, respectively, to the underside of the board such that a second portion of the second wheel assembly is displaceable with respect to the board; orienting the first and second axis such that the first and second axis are non-parallel; and orienting the third and fourth axis such that the third and fourth axis are non-parallel.

BRIEF DESCRIPTION OF THE DRAWINGS

Various embodiments are disclosed, by way of example only, with reference to the accompanying schematic drawings in which corresponding reference symbols indicate corresponding parts, in which.

DETAILED DESCRIPTION

At the outset, it should be appreciated that like drawing numbers on different drawing views identify identical, or functionally similar, structural elements of the disclosure. It is to be understood that the disclosure as claimed is not limited to the disclosed aspects.

Furthermore, it is understood that this disclosure is not limited to the particular methodology, materials and modifications described and as such may, of course, vary. It is also understood that the terminology used herein is for the purpose of describing particular aspects only, and is not intended to limit the scope of the present disclosure.

Unless defined otherwise, all technical and scientific terms used herein have the same meaning as commonly understood to one of ordinary skill in the art to which this disclosure belongs. It should be understood that any methods, devices or materials similar or equivalent to those described herein can be used in the practice or testing of the disclosure.

Figure 1:
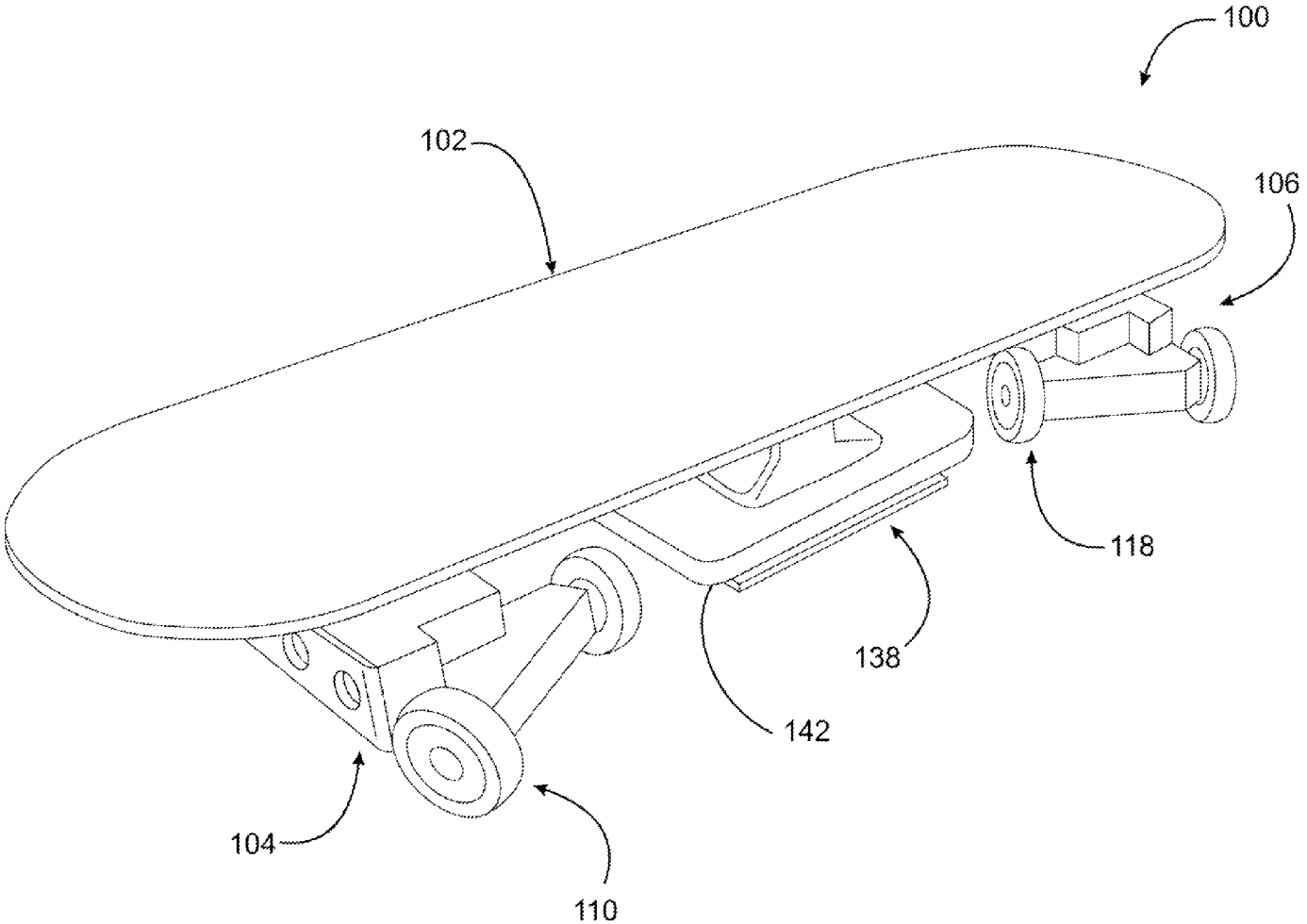
FIG. 1 is a top perspective view of a snowboard training device.

FIG. 1 is a top perspective view of snowboard training device 100.

Figure 2:
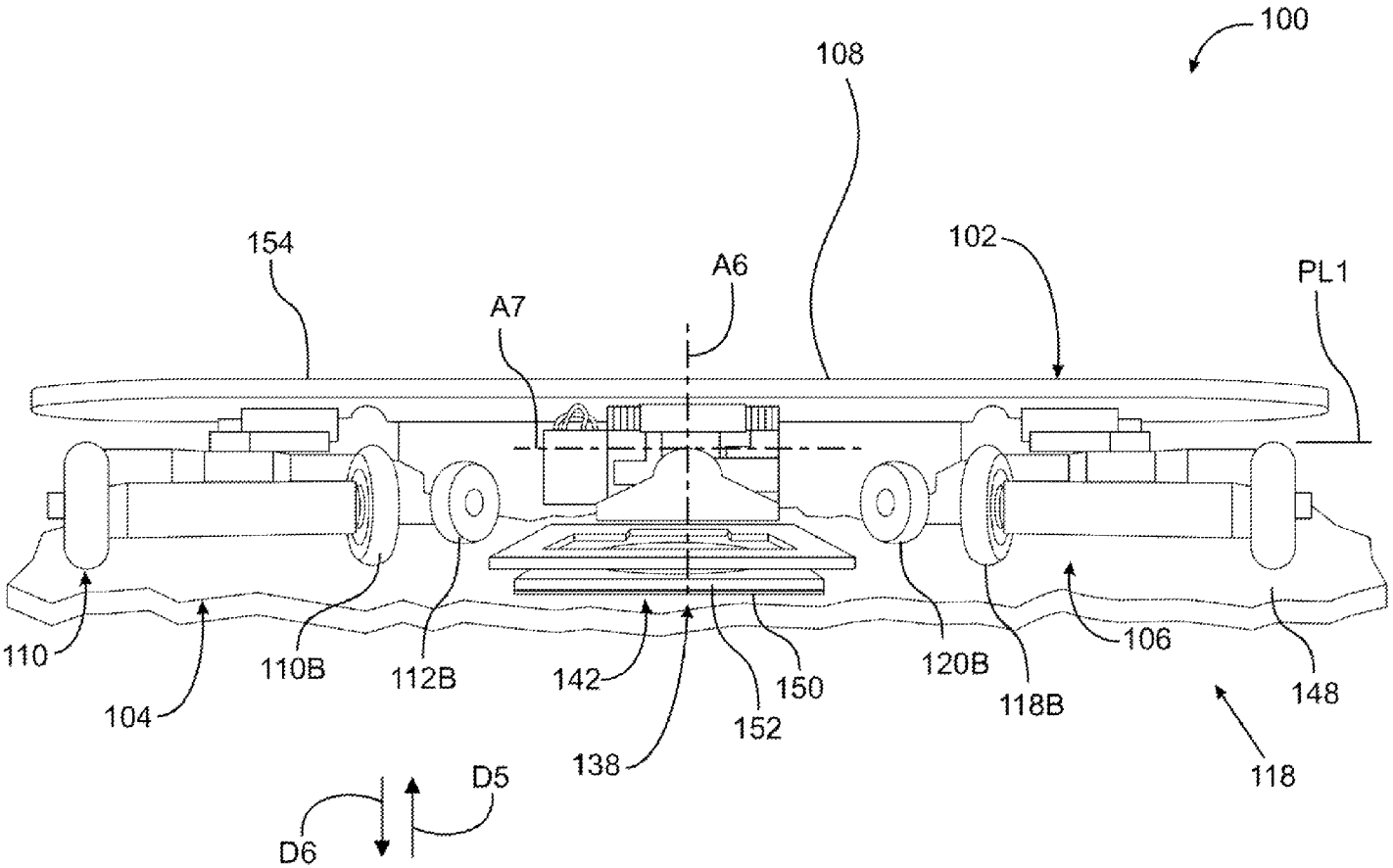
FIG. 2 is a side view of the snowboard training device shown in FIG. 1.

FIG. 2 is a side view of snowboard training device 100 shown in FIG. 1.

Figure 3:
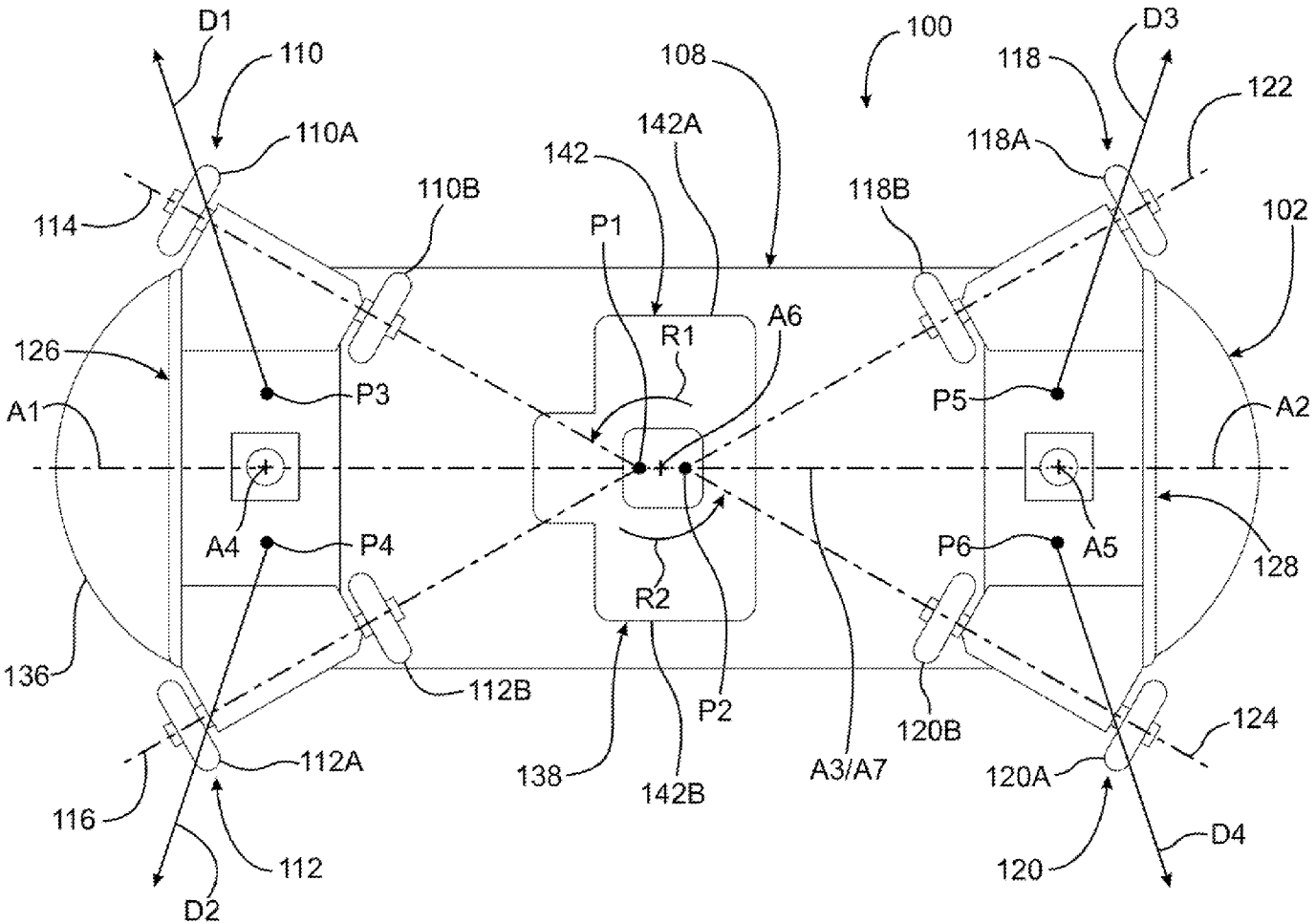
FIG. 3 is a bottom view of the snowboard training device shown in FIG. 1.

FIG. 3 is a bottom view of snowboard training device 100 shown in FIG. 1.

Figure 4:
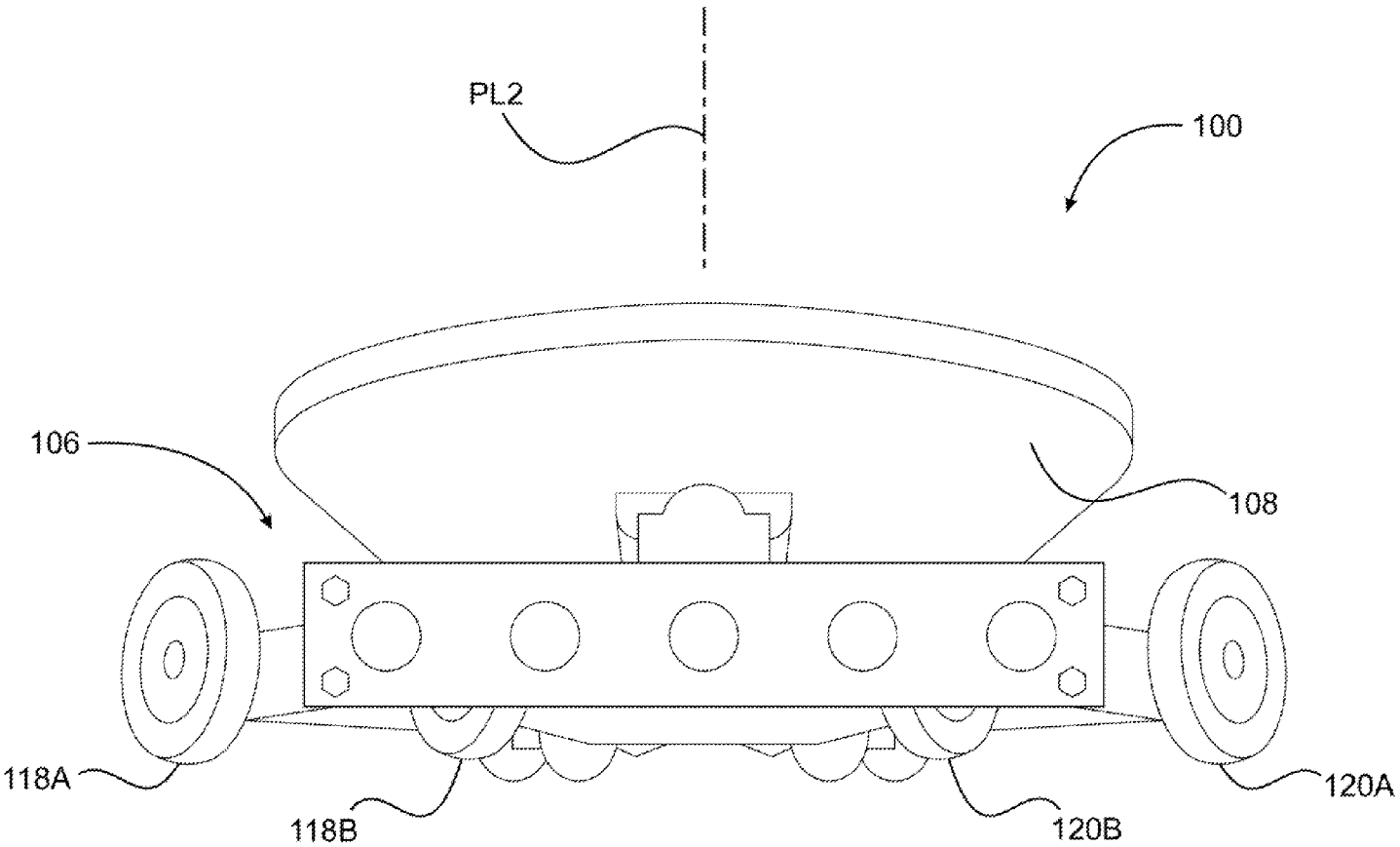
FIG. 4 is an end view of the snowboard training device shown in FIG. 1.

FIG. 4 is an end view of snowboard training device 100 shown in FIG. 1. The following should be viewed in light of FIGS. 1 through 4. Device 100 includes board 102 and wheel assemblies 104 and 106. The wheel assemblies are connected to underside 108 of the board. Wheel assembly 104 includes pair 110 and 112 of wheels rotatable about axis of rotation 114 and 116, respectively. Wheel assembly 106 includes pairs 118 and 120 of rotatable wheels axis of rotation 122 and 124, respectively. In an example embodiment, axis of rotation 114 and 116 are non-parallel. In an example embodiment, axis of rotation 122 and 124 are non-parallel. In an example embodiment, axis 114 and 116 intersect at point P1 between assemblies 104 and 106. In an example embodiment, axis 122 and 124 intersect at point P2 between assemblies 104 and 106.

Board 102 can be made of any material known in the art, including, but not limited to laminates or natural and/or synthetic materials. Board 102 is not limited to a particular size, shape, or thickness. The wheels for pairs 110, 112, 118, and 120 can be any wheels known in the art.

Figure 5B:
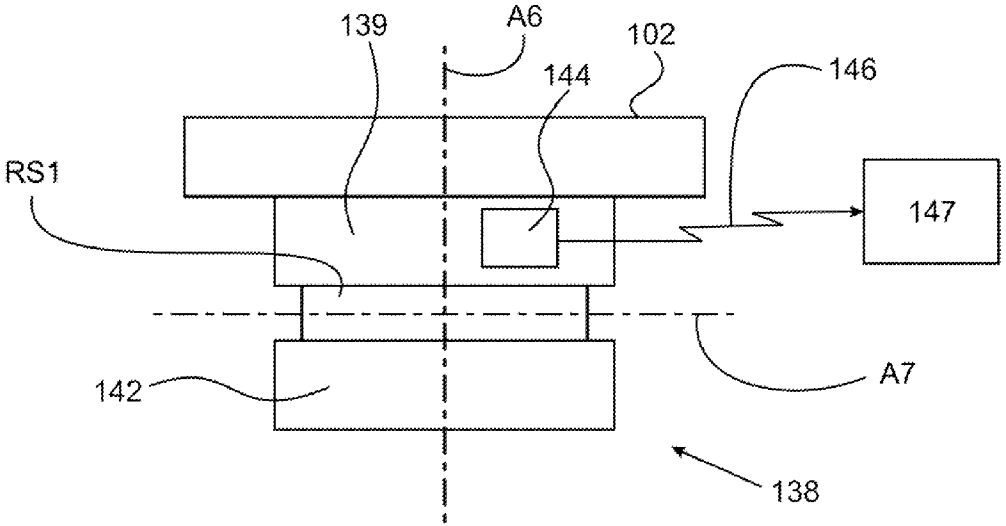
FIG. 5B is a schematic block diagram of a swiveling and rotating center assembly.
Figure 5A:
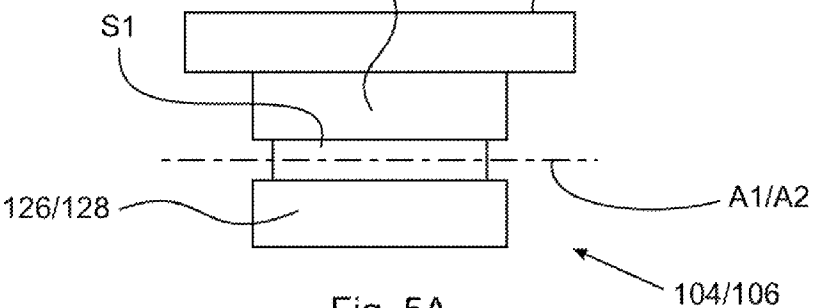
FIG. 5A is a schematic block diagram of a swiveling wheel assembly.

FIG. 5A is a schematic block diagram of a swiveling wheel assembly. The following should be viewed in light of FIGS. 1 through 5A. In an example embodiment, portions 126 and 128 of assemblies 104 and 106 are displaceable with respect to the board. In an example embodiment, portions 126 and 128 are arranged to swivel about axis A1 and A2, passing through assemblies 104 and 106, respectively. For example, as shown in FIG. 5A, portion 127 is fixed to board 102 and portion S1 enables portions 126/128 to swivel about axis A1/A2 with respect to portion 127 and board 102. It should be understood that portions 127 and S1 could be integral and that portion 127 could be integral to board 102. Any means known in the art can be used for portion 127, including, but not limited to, various spring and torsion bar configurations.

In an example embodiment, axis A1 and A2 are part of a single axis A3 passing through assemblies 104 and 106. In an example embodiment, axis A1, A2, and A3 are substantially parallel to board 102. In an example embodiment, axis A1, A2, and A3 do not intersect board 102. In an example embodiment, the board includes outer peripheral edge 136 enclosing the underside. Wheel 110A extends beyond the outer peripheral edge in a direction D1 from a point P3 on wheel assembly 104 to the outer peripheral edge. Wheel 112A extends beyond the outer peripheral edge in a direction D2 from a point P4 on wheel assembly 104 to the outer peripheral edge. In an example embodiment, wheels 118A and 120A extend beyond the outer peripheral edge in directions D3 and D4 from point P5 and P6 on wheel assembly 104, respectively, to the outer peripheral edge.

In an example embodiment, assembly 104, in particular, portion 126, is arranged to swivel such that as wheel 110B approaches side 108 (moves in the general direction of D5), wheel 112B moves away from side 108 (moves in the general direction of D6). That is, portion 126 rocks about axis A1. In like manner, portion 128 is arranged to swivel such that as wheel 118B approaches side 108 (moves in the general direction of A5), wheel 120B moves away from side 108 (moves in the general direction of A6). That is, portion 128 rocks about axis A2.

In an example embodiment, assemblies 104 and 106 are fixed with respect to rotation about axis A4 and A5, substantially orthogonal to the underside of the board and passing through assemblies 104 and 106, respectively. Thus, in an example embodiment, assemblies 104 and 106 are fixed with respect to movement, in particular, rotation in plane PL1 parallel to side 108, but can swivel with respect to side 108, for example, in plane PL2, respectively, orthogonal to PL1 and passing through axis A4 and A5.

FIG. 5B is a schematic block diagram of swiveling and rotating center assembly 138. The following should be viewed in light of FIGS. 1 through 5B. Device 100 includes center assembly 138 connected to the underside of the board between assemblies 104 and 106. At least a portion of assembly 138 is able to rotate independently of the board, for example, about axis A6 passing though the board. For example, portion 139 is fixed to board 102 and portion 142 is able to rotate about axis A6 via rotation/swivel device RS1. Any means known in the art can be used for the rotating portion of RS1. It should be understood that portions 139 and RS1 can be integral and that portion 139 can be integral to board 102.

In an example embodiment, portion 142 of assembly 138 is arranged to swivel about axis A7, passing through assembly 138, in a manner similar to that described for portions 126/128 of assemblies 104/106. In an example embodiment, axis A7 is part of axis A3. For example, as shown in FIG. 5B, portion 139 is fixed to board 102, or integral to the board, and portion RS1 enables portion 142 to swivel about axis A7 with respect to portion 139 and board 102. Any means known in the art can be used for the swiveling portion of RS1, including, but not limited to, various spring and torsion bar configurations.

In an example embodiment, assembly 138, in particular, portion 142, is arranged to swivel such that as end 142A approaches side 108 (moves in the general direction of D5), end 142B moves away from side 108 (moves in the general direction of D6). That is, portion 142 rocks about axis A7.

In an example embodiment, the center assembly includes positional assembly 144 arranged to generate signal 146 including information regarding a position of the center assembly with respect to the board or movement of the center assembly with respect to the board. The positional assembly is arranged to transmit the signal to a computer-based device 147 so that, for example, the signal can be used to generate a video image simulating movement of the board. In an example embodiment, the positional assembly is arranged to generate the signal including information regarding rotation of the center assembly about axis A6 and swiveling of the center assembly with respect to axis A7.

Assembly 144 can include any mechanical and electrical components known in the art. Assembly 144 can be powered by line power or by an on-board power source, such as a battery, or rechargeable battery. Assembly 144 can transmit the signal using any means known in the art, including, but not limited to hard wire transmission and wireless transmission. In the figures, signal 146 is shown as a wireless signal.

In use, device 100 can be placed on a substantially planar and level surface, for example, surface 148 in FIG. 2. Contact of assembly 138 with the surface fixes assembly 138 with respect to the floor. In an example embodiment, on-skid pads or material 150 is placed on surface 152 of portion 142 such that material 150 firmly contacts the surface. Wheels pairs 110, 112, 118, and 120 are in contact with the surface. The user mounts top surface 154 of the board and by shifting balance and weight distribution causes the board to rotate about assembly 138 (in particular, portion 142) and swivel with respect to assemblies 104, 106, and 138 in a manner simulating movement of a ski board in use. Wheels pairs 110, 112, 118, and 120 are oriented, in particular, axes 114 and 116 and axes 122 and 124 are oriented, to cause the board rotate about axis A6, for example, in directions R1 and R2, in response to movement or shifting by the user. Assembly 144 tracks and monitors the displacement of the board. Thus signal 146 enables an accurate approximation of how the movements of the center assembly, and by extension of the user, translate into use of a snowboard.

Figure 6:
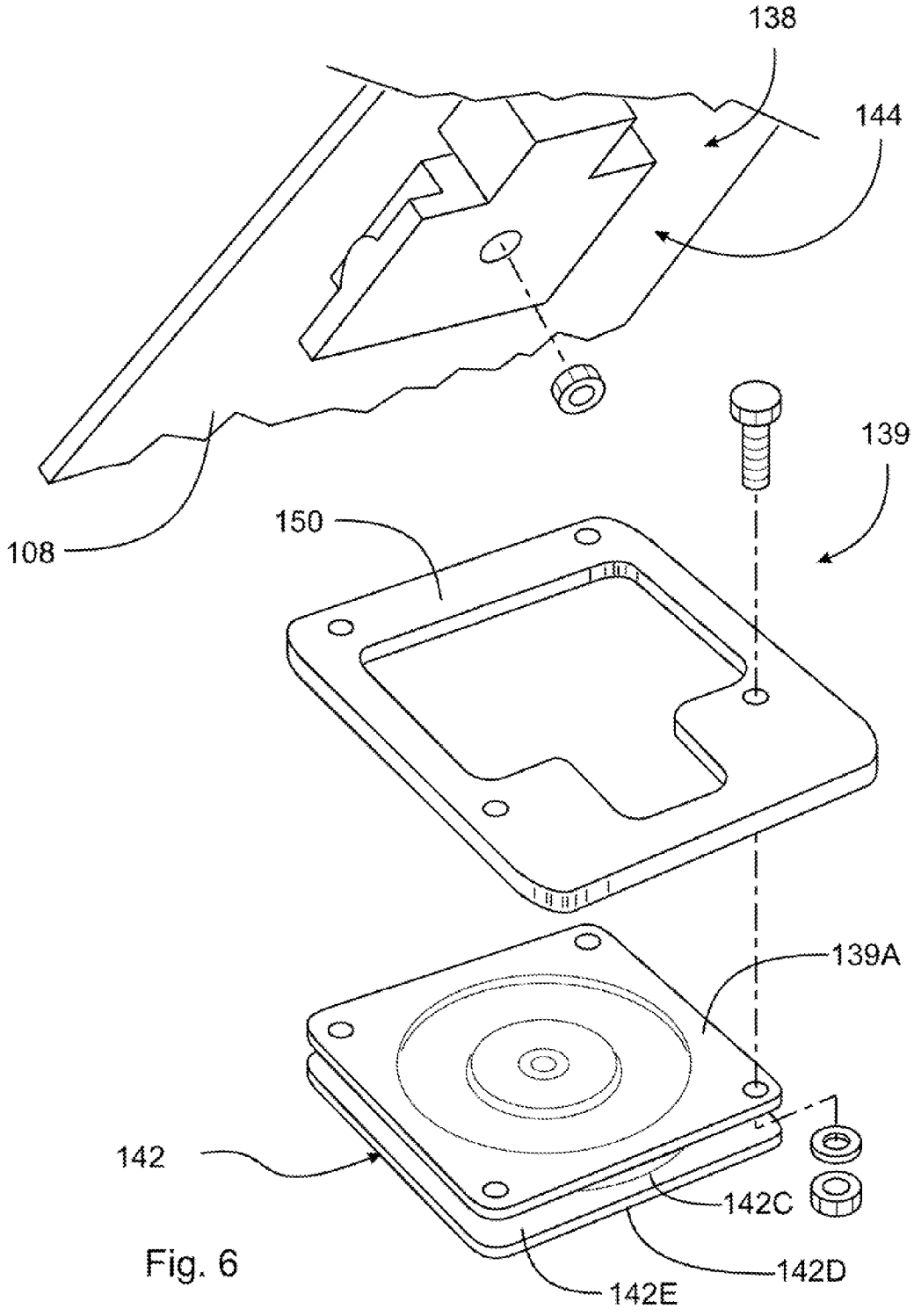
FIG. 6 is an exploded view of a wheel assembly shown in FIG. 1.

FIG. 6 is an exploded view of wheel assembly 138 shown in FIG. 1. The following provides further example detail regarding device 100. In an example embodiment, portions 139 and RS1 include a rotating spring loaded top plate 139A fixed to board 102 via spacer 150. Portion 142 includes portion 142C including bearings and one or more springs, which enable the swiveling motion of 142. 142 also includes resilient pad 142D, connected to fixed bottom plate 142E, which counters and cushions the swiveling motion of 142. For example, the pad enables 139A to "bounce back" from an extreme swiveling position.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What I claim is:

1. A snowboard training device, comprising:

a board;

a first wheel assembly connected to an underside of the board and including first and second pairs of rotatable wheels with first and second axes of rotation, respectively; and, a second wheel assembly connected to the underside of the board and including third and fourth pairs of rotatable wheels with third and fourth axes of rotation, respectively, wherein:

the first and second axes are non-parallel;

the third and fourth axes are non-parallel; and, first and second portions of the first and second wheel assemblies, respectively, are displaceable with respect to the board.

2. The snowboard training device of claim 1, wherein:

the first and second portions of the first and second wheel assemblies, respectively, are arranged to swivel about fifth and sixth axes, respectively, passing through the first and second wheel assemblies, respectively.

3. The snowboard training device of claim 2, wherein the fifth and sixth axes are substantially parallel to the board and do not pass through the board.

4. The snowboard training device of claim 1, wherein:

the board includes an outer peripheral edge enclosing the underside;

a first wheel from the first pair of rotatable wheels extends beyond the outer peripheral edge; and, a second wheel from the second pair of rotatable wheels extends beyond the outer peripheral edge.

5. The snowboard training device of claim 1, wherein:

the board includes an outer peripheral edge;

a respective wheel from each of the first and second pair of rotatable wheels extends beyond the outer peripheral edge; and, a respective wheel from each of the third and fourth pair of rotatable wheels extends beyond the outer peripheral edge.

6. The snowboard training device of claim 1, wherein the first wheel assembly is arranged to swivel such that:

as a first wheel from the first pair of rotatable wheels approaches the underside of the board a second wheel from the second pair of rotatable wheels moves away from the underside of the board.

7. The snowboard training device of claim 1, wherein the first and second wheel assemblies are arranged to swivel such that:

as respective first wheels from the first and third pairs of rotatable wheels approach the underside of the board respective second wheels from the second and fourth pairs of rotatable wheels move away from the underside of the board.

8. The snowboard training device of claim 1, wherein:

the first and second axes intersect at a first point between the first and second wheel assemblies; and, the third and fourth axes intersect at a second point between the first and second wheel assemblies.

9. The snowboard training device of claim 1, wherein the first wheel assembly is fixed with respect to rotation about an axis passing through the board and the first and second wheel assemblies are fixed with respect to rotation about an axis passing through the board and the second wheel assembly.

10. The snowboard training device of claim 1, further comprising a center assembly connected to the underside of the board, between the first and second wheel assemblies, so as to rotate independently of the board.

11. The snowboard training device of claim 10, wherein:

at least a portion of the center assembly is arranged to swivel such that:

as a first end of the center assembly approaches the underside of the board a second end of the center assembly, opposite the first end of the center assembly, moves away from the underside of the board.

12. The snowboard training device of claim 10, wherein at least a portion of the center assembly is arranged to swivel about an axis passing through the first and second wheel assemblies.

13. The snowboard training device of claim 10 wherein:

the center assembly includes a positional assembly arranged to generate a signal including information regarding a position of the center assembly with respect to the board or movement of the center assembly with respect to the board; and, the positional assembly is arranged to transmit the signal to a computer-based device so that the signal can be used to generate a video image simulating movement of the board.

14. The snowboard training device of claim 13 wherein:

the center assembly is arranged to rotate about a seventh axis passing through the board;

the center assembly is arranged to swivel about an eighth axis orthogonal to the seventh axis; and, the positional assembly is arranged to generate the signal including information regarding:

rotation of the center assembly with respect to the seventh axis; and, swiveling of the center assembly with respect to the eighth axis.

15. A snowboard training device, comprising:

a board;

first and second wheel assemblies connected to an underside of the board, wherein each of the first and second wheel assemblies is non-parallel with respect to a longitudinal axis of the board and each of the first and second wheel assemblies supports a plurality of wheels, respectively; and, a center assembly connected to the underside of the board, wherein:

at least a portion of the center assembly is rotatable about an axis, wherein the axis is substantially perpendicular with respect to the board; and, respective portions of the first and second wheel assemblies are pivotable with respect to the board about respective axes parallel to the longitudinal axis of the board and each wheel of the first and second wheel assemblies is secured such that each wheel is non-parallel with respect to the longitudinal axis of the board, respectively.

16. A method of forming a snowboard training device, comprising:

connecting a first wheel assembly, including first and second pairs of rotatable wheels with first and second axes of rotation, respectively, to an underside of a board such that a first portion of the first wheel assembly is displaceable with respect to the board;

connecting a second wheel assembly, including third and fourth pairs of rotatable wheels with third and fourth axes of rotation, respectively, to the underside of the board such that a second portion of the second wheel assembly is displaceable with respect to the board;

orienting the first and second axes such that the first and second axes are non-parallel; and, orienting the third and fourth axes such that the third and fourth axes are non-parallel.

17. The method of claim 16, wherein:

connecting the first and second wheel assemblies to the underside includes arranging the first and second portions to swivel about fifth and sixth axes, respectively passing through the first and second wheel assemblies, respectively; or, connecting the first and second wheel assemblies to the underside includes arranging the first and second portions to swivel about fifth and sixth axes, respectively, that do not pass through the underside.

18. The method of claim 16, wherein connecting the first and second wheel assemblies to the underside includes arranging the first and second portions such that:

the first and second axes intersect at a first point between the first and second wheel assemblies; and, the third and fourth axes intersect at a second point between the first and second wheel assemblies.

19. The method of claim 16, further comprising connecting a center assembly to the underside of the board such that at least a portion of the center assembly is:

rotatable with respect to a seventh axis passing through the board; and, pivotable with respect to the board about an eighth axis orthogonal to the seventh axis.

20. The method of claim 16, further comprising using the center assembly to:

generate a signal including information describing position or movement of the center assembly with respect to the board; and, transmit the signal to a computer-based device.

* * * * *